United States Patent [19]

Bauman et al.

[11] 3,996,685

[45] Dec. 14, 1976

[54] SHELL CUT-OFF LATCH

[75] Inventors: Thomas G. Bauman; Robert J. Balaska, both of Ilion, N.Y.

[73] Assignee: Remington Arms Company, Inc., Bridgeport, Conn.

[22] Filed: Nov. 14, 1975

[21] Appl. No.: 632,143

[52] U.S. Cl. ..... 42/17; 42/40

[51] Int. Cl.[2] ..... F41C 11/00

[58] Field of Search ..... 42/17, 21, 16, 20, 2, 42/8, 12, 40, 75 D

[56] References Cited

UNITED STATES PATENTS

| | | | |
|---|---|---|---|
| 1,802,198 | 4/1931 | Cosmi | 42/21 |
| 3,201,886 | 8/1965 | Kelly et al. | 42/17 |
| 3,318,192 | 5/1967 | Miller et al. | 42/16 |

*Primary Examiner*—Charles L. Jordan

*Attorney, Agent, or Firm*—John H. Lewis, Jr.; Nicholas Skovran; William L. Ericson

[57] ABSTRACT

A shell cut-off latch for use in a break-open firearm having a magazine tube mounted parallel to the firearm barrel. The cut-off latch functions to retain cartridge(s) in the magazine tube when the firearm is in the break-open position and is cammed out of latching position when the firearm is in closed position and the action assembly and bolt means are in the forward, ready-to-fire position.

8 Claims, 5 Drawing Figures

SHELL CUT-OFF LATCH

The present invention relates to an autoloading break-pen firearm such as an over-and-under shotgun and could encompass a similar type rifle if the rifle utilized a magazine tube positioned parallel to the barrel. More particularly, the invention relates to a shell cut-off latch to prevent cartridges stored in the magazine tube from flying out of the gun either while the gun is being maneuvered into or after it is in a break-open position.

The concept of a cut-off latch to prevent expulsion of cartridge(s) from either a gun chamber or a magazine tube is not novel in itself. For example, U.S. Pat. No. 890,186 (Singer) shows a device for a break-open gun which retains the cartridge in the chamber when the gun is broken open. Other designs in the prior art also called "shell cut-off" devices are used in autoloading and pump shotguns to restrain the cartridge in a magazine tube. The present invention differs in that the cut-off device prevents cartridges from leaving a magazine tube in a break-open gun while in the broken-open position and thus serves a different purpose in the gun's function and safety.

It can be seen that where an autoloading, break-open gun has a magazine tube in which a spring biased follower exerts pressure on cartridges in the magazine tube, the cartridges must be restrained when the gun is broken open or the cartridges will be projected towards the shooter's face. Most latches or stops in conventional autoloading guns are mounted on the gun frame and generally actuated by a cam on the action bar assembly. However, when the break-open feature is introduced, these latches or stops remain stationary and eventually inoperative when the magazine tube pivots with the barrel assembly relative to the gun frame. Thus, it becomes necessary to position the shell cut-off latch so that it is not rendered inoperative when the barrel assembly pivots or breaks open relative to the gun frame.

It is an object of the present invention to provide a cut-off latch to prevent cartridges loaded in a magazine tube of a break-open gun from being ejected toward the shooter when the gun is broken open.

Another object of the present invention is to provide a pivoted shell cut-off latch on the barrel assembly of a break-open gun which is operative to prevent cartridges from being expelled from a magazine tube attached to the barrel assembly when the gun is broken open.

Another object of the present invention is to provide a cut-off latch for an autoloading break-open gun which is cammed out of blocking position when the gun is closed and the bolt means is moved forward to firing position.

Other objects and advantages will become apparent from the following description taken in conjunction with the accompanying drawing in which.

The purpose of the shell cut-off latch, as used in an autoloading break-open firearm, is to provide a safety feature and prevent shells loaded into the magazine tube from flying out of the gun, either while the gun is being maneuvered to a break-open position or after it is in a break-open position. It is not intended to secure shells in the magazine tube during disassembly of the gun's components for care, cleaning, inspection, storage, or any other disassembly of the gun into its component parts.

Figure 2:
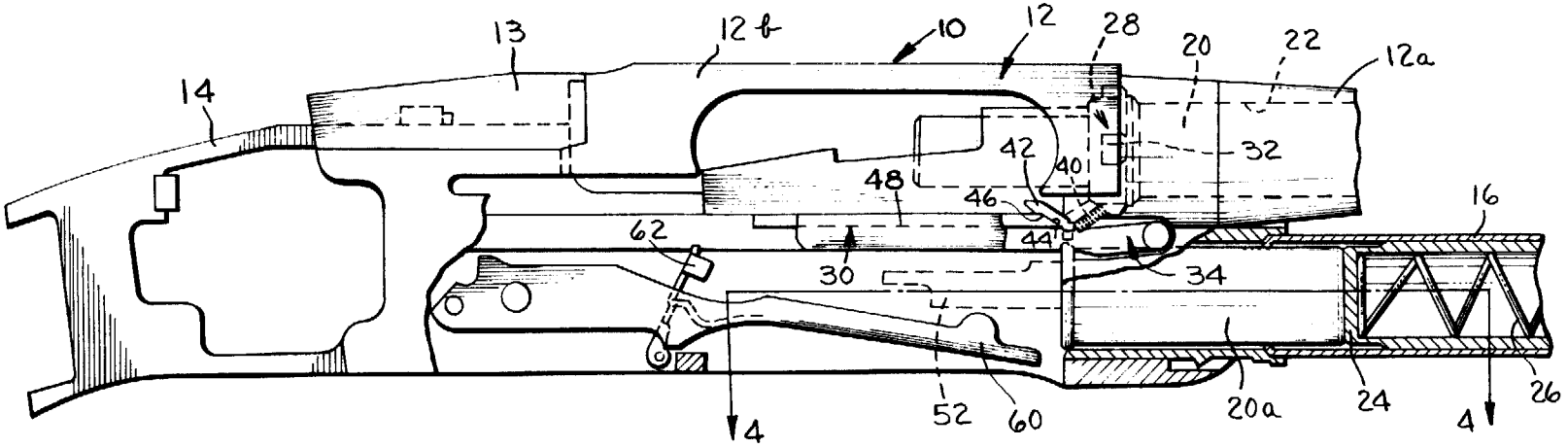
FIG. 2 is a side view of the break-open shotgun of FIG. 1 with the cartridge chambered and the bolt in forward, ready-to-fire position.

The gun ready-to-fire or the gun ready-to-load magazine position is shown in FIG. 2 and the description of the invention will begin at this point. FIG. 2 shows a break-open gun 10 in closed position, i.e. the barrel assembly 12 is pivoted to a horizontal position and is locked by means of a top lock 13 slidably mounted on gun frame 14. A magazine tube 16 is connected to the underside of the barrel assembly by any well known means, e. g. a slip fit or press fit. The barrel assembly includes an elongated barrel 12a and a barrel extension 12b in which a port hole 18 is formed to permit ingress and egress of a cartridge 20. For purposes of this application, the numeral 20 will be used to designate a cartridge in the gun chamber 22 of the barrel assembly and the numeral 20a will designate the rearmost cartridge in the magazine tube 16. In FIG. 2 the forward end of cartridge 20a abuts a magazine tube follower 24 which is biased rearwardly by a coil spring 26.

FIG. 2 shows a cartridge 20 in chamber 22 and a bolt means 28 and associated action bar assembly 30 in the forward, locked up position with the bolt head locking lugs 32 in appropriate recesses (not shown) in the barrel assembly. Action bar assembly 30 consists of parallel, left and right forwardly-extending action bars 30*a* connected by a rear transverse section 48 on which the bolt means is mounted.

Figure 5:
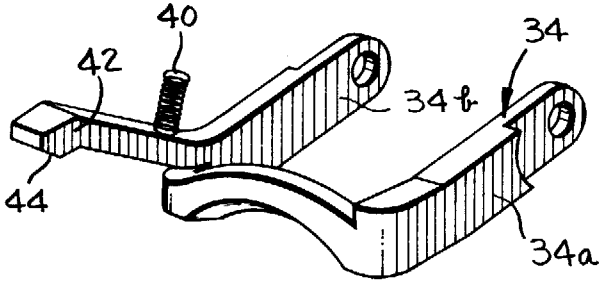
FIG. 5 is a perspective view of the shell cut-off latch.

The shell cut-off latch 34 (see FIG. 5) is a U-shaped member having parallel legs 34a and 34b which are inserted in recess cuts 36 on opposite sides of the barrel extension so as to straddle the barrel extension and pivoted therein on pivot pin 38. The cut-off latch is spring loaded downwardly at all times by the cut-off latch spring 40 located on the left side of the barrel extension between the shell cut-off latch and the barrel extension latch recess cut. In this description, when reference is made to "right" or "left", it is assumed the reader is standing to the rear of the gun and looking toward the muzzle of the gun. An extended arm 42 on the left side of the shell cut-off latch provides a cam 44 for movement of the cut-off latch in a vertical direction only. This cam 44 is engaged by a cam 46 on action bar transverse section 48. This provides full movement of the shell cut-off latch when the action bar assembly is fully forward, so that the bolt head 50 is locked up and ready to fire. At this time only, the two cams 44 and 46 are fully engaged and provide maximum upward movement of the shell cut-off latch. Also, at this time, a cartridge 20a is allowed to move rearwardly under pressure of spring 26 to position itself onto the face of feed latch 52 (see FIG. 4). The feed latch is mounted on the right side of the frame and is normally biased inwardly by spring 54.

Still referring to FIG. 2, the shell cut-off latch 34 is held out of its normal biased-down position in the barrel assembly by the full engagement of the action bar assembly cam 46 and the shell cut-off latch cam 44. Additional cartridges are now free to be loaded through the magazine tube opening in the barrel extension as the shell cut-off latch is cammed out of the feeding shells way.

Figure 4:
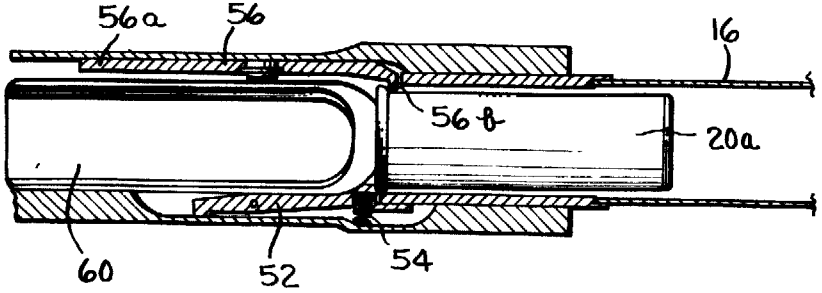
FIG. 4 is a top view along Line 4–4 of FIG. 2 showing the relationship of the interceptor latch, the feed latch and the rearmost cartridge in the magazine tube.

The third latch used to control the movement of cartridges in the magazine tube is the interceptor latch 56, which is pivotally mounted on the left side of the gun frame (see FIG. 4). Interceptor latch 56 has an elongated rear portion 56*a* and a forward portion having an inwardly-projecting lug 56*b*. The rear portion 56*a* of the interceptor latch normally is biased upwardly so as to pivot the forward lug end 56*b* downwardly out of cartridge engaging position. Upon firing, the forward end of a disconnector 58 is biased downwardly against the rear portion 56*a* of the interceptor so that the forward end 56*b* is pivoted upwardly to be positioned forwardly of the rim to catch and hold cartridge 20*a* onto the face of the feed latch during recoil and remain in cartridge blocking position relative to the second cartridge in the magazine tube. For a more detailed explanation of the function of the interceptor latch 56 and the disconnector 58, see U.S. Pat. No. 3,201,886, issued to R. P. Kelly et al on Aug. 24, 1965.

Referring still to the ready-to-fire position of FIG. 2, at this time the interceptor latch 56 is pivoted out of the way so as not to block movement of cartridges into and out of the magazine tube (see FIG. 4). However, at the same time, the feed latch 52 is spring loaded into the path of the feeding or loading cartridge. The loading cartridge, i. e. when a cartridge is being fed into the magazine tube, will force the feed latch out of the way temporarily until the cartridge is pushed past the feed latch face. Then the spring 54 will snap the feed latch behind the loading cartridge and retain it in the magazine tube. The feed latch is not being cammed by the action bar assembly at this time so that the cartridges are retained in the magazine tube by the feed latch.

Upon firing, the gun starts to unlock. As the action bar assembly moves rearward, the shell cut-off cam 44 disengages from the action bar assembly cam 46 thus allowing the cut-off latch to return by spring pressure to its normal, biased downward position. It will return on top of the cartridge ready to be fed and snap down in blocking position when the feeding cartridge 20*a* leaves the magazine tube.

Figure 1:
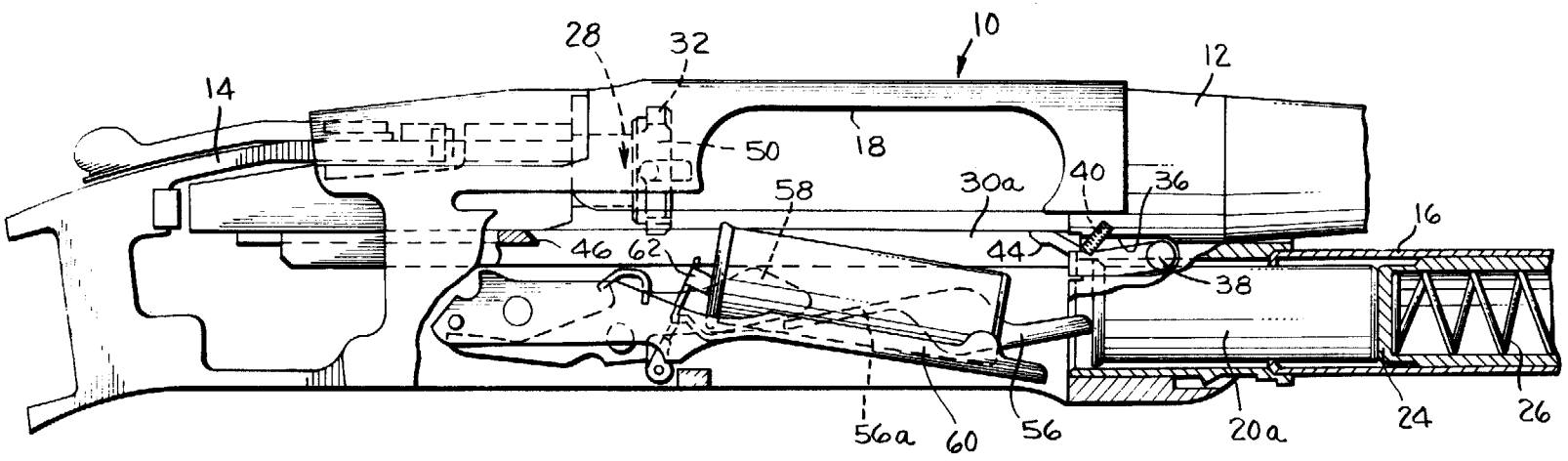
FIG. 1 is a side view with portions shown in cross section of a break-open shotgun in closed position with the bolt in a rearward position and a cartridge released onto the carrier plate prior to being fed into the gun chamber.

After firing, the action bar assembly and the attached bolt means 28 are moved all the way to the rear and locked (latching means not shown.) FIG. 1 shows the locked-open position of the gun wherein the action bar assembly and bolt means are locked in their rearward position and the barrel extension and gun chamber are "open" to permit feeding of a cartridge into the gun chamber, either by means of carrier plate 60 or by manually inserting a cartridge through the port hole 18. Just prior to being "locked open"to the position shown in FIG. 1, the feed latch 52 is cammed out of the path of feeding shell 20*a* by a cam means (not shown) on the right leg 30*a* of the action bar means. This permits cartridge 20*a* to be thrust out of the magazine tube by spring 26 onto carrier plate 60 until the cartridge actuates the carrier latch 62 which disengages the carrier mechanism allowing it to raise the cartridge to an elevated position where it is picked up by the bolt means moving forwardly for insertion into the gun chamber.

The feed latch, the camming of the feed latch by the action bar assembly, and the actuation of the carrier latch to disengage the carrier mechanism are not novel to the present invention.

Figure 3:
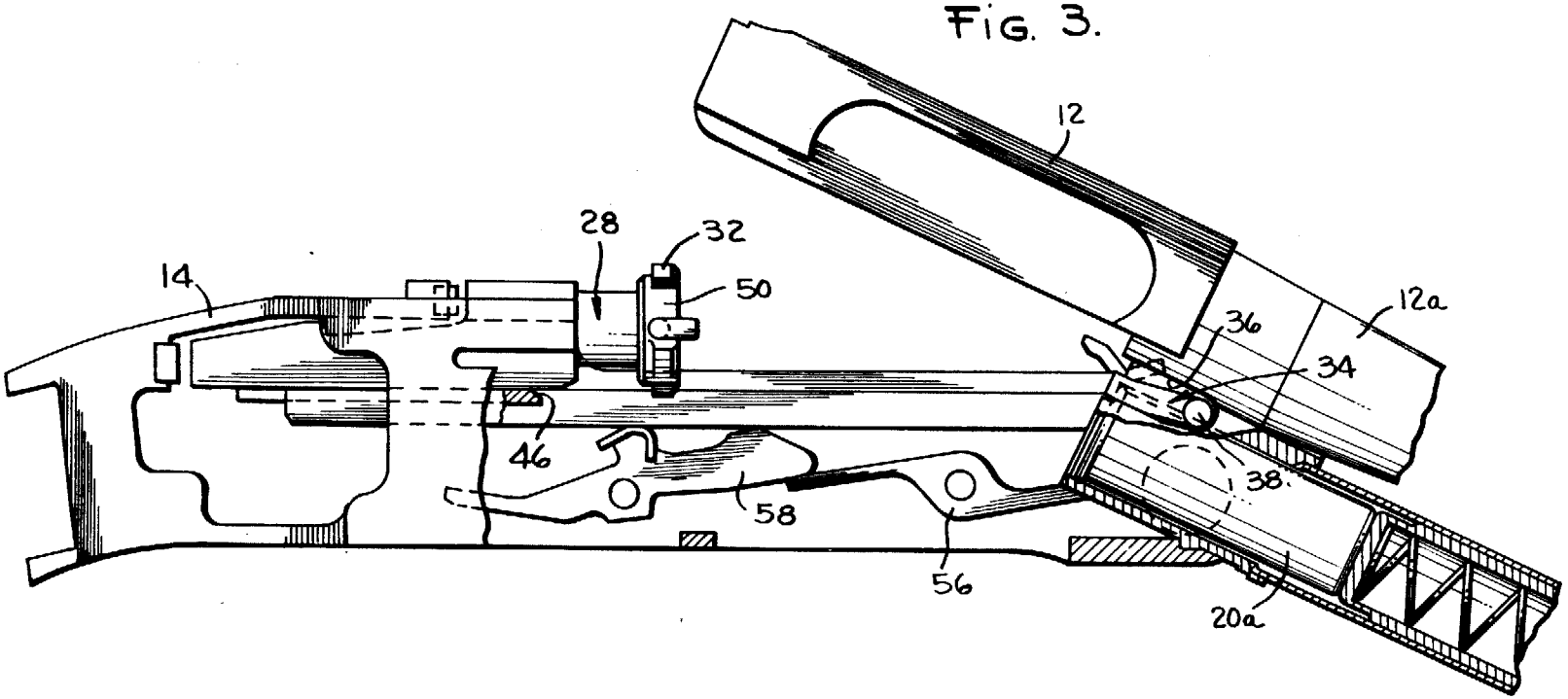
FIG. 3 is an elevational view of the break-open shotgun of FIG. 1 wherein the barrel assembly is pivoted relative to the gun frame and the shell cut-off latch is shown blocking a cartridge in the magazine tube with the interceptor latch and the feed latch in inoperative position.

If there is no cartridge present in the magazine tube, the gun ceases to function and the action bar assembly and bolt means stays locked open as shown in FIG. 1. At this time only can the gun be moved to the break-open position shown in FIG. 3. At any other time, as mentioned in the above sequence the gun is latched shut and cannot be brought to a break-open position except by manual operation of the action bars being brought to a locked open position even if there are cartridges still in the magazine tube and chamber.

Now is when the shell cut-off latch comes into play. As the gun is being brought to a break-open position, any cartridges 20*a* still in the magazine tube will be temporarily held in position by the face of lug 56*b* of interceptor latch 56. Through continued pivoting of the barrel assembly 12 away from the frame 14, the rear face of cartridge 20*a* will eventually lose contact with the interceptor lug 56*b* and try to exit the magazine tube, as the interceptor latch 56 is fixed to the frame 14 and the cartridge 20*a* is now moving with the barrel assembly 12 away from the frame. The feed latch 52 is also fixed to the frame and is at this time cammed out of holding position because the action bar assembly is fully rearward and locked open. The shell cut-off latch, being the only latch member attached to and travelling with the barrel assembly, now provides a stop surface for the cartridge 20*a* in the magazine tube once it loses contact with the interceptor latch lug 56*b*.

It was mentioned above that as the action bar assembly starts rearward after firing, the shell cut-off latch cam 44 and the action bar assembly cam 46 disengage and the cut-off latch is now spring loaded downwardly to interrupt the path of the new rearmost cartridge in the magazine tube. It should be noted that the three latches, i. e. the feed latch 52, shell cut-off latch 34, and interceptor latch 56, are positioned in relation to each other that they can work independently of each other and still control the cartridge's movement and position. When the cartridge's rim is against the feed latch, the shell cut-off latch may move up or down, depending on the position of the action bar assembly, without disturbing the cartridge ready to be fed. When feeding cartridge 20*a* is about to be fed, the shell cut-off latch is in its down position in the path of any other cartridges in the magazine tube since the action bar assembly is to the rear.

The feeding cartridge 20*a* is actually sandwiched between the feed latch face and the shell cut-off latch. Interceptor latch 56 is up ready to intercept cartridges in the magazine tube. Upon recoil, feeding cartridge 20*a* may move forwardly to cam shell cut-off latch up temporarily. However, interceptor latch is in position to prevent this cartridge from by-passing it and will allow the cartridge to return against the feed latch when recoil is over.

What is claimed is:

1. A break-open firearm in which a barrel assembly is hinged to a frame so that when unlatched, the barrel assembly and frame can pivot relative to each other from a closed position to a break-open positon, said barrel assembly comprising an elongated barrel having a chamber therein, a magazine tube, open-ended at its rear end, extending adjacent to and parallel to said barrel for receiving a plurality of cartridges placed end-to-end, means biasing said cartridges rearwardly toward said open end of the magazine tube, stop means on said frame engaging said rearmost cartridge to prevent release of said cartridge when said barrel assembly and frame are in a closed, ready-to-fire position, action slide means operable to cam said stop means to permit the rearmost cartridge to be released, means feeding the released cartridge into the chamber, and a cut-off latch for preventing a rearmost cartridge from being pushed out of the magazine tube by said cartridge biasing means when the barrel assembly and the frame are in the break-open position.

2. A break-open firearm as recited in claim 1 wherein said cut-off latch is pivotally mounted on said barrel assembly, and means biasing said cut-off latch toward said open end of the magazine tube into cartridge blocking position.

3. A break-open firearm as recited in claim 2 wherein said cut-off latch comprises a cam finger extending rearwardly and upwardly therefrom, a cut-off latch cam means on said action slide means for engaging said cam finger when the action slide means is in its forward, breech lock-up position whereupon said camming action causes the cut-off latch to be raised against the cut-off latch biasing means and out of cartridge blocking position.

4. A break-open firearm as recited in claim 2 wherein said cut-off latch comprises a U-shaped member having a pair of legs connected by a rear section which has a cartridge engaging lip thereon, means pivoting said leg members to said barrel assembly so that said means biasing said cut-off latch normally biases the connecting rear section of the latch and the lip thereon into position over the open end of the magazine tube so that said lip projects down rearwardly of and in the path of said rearmost cartridge when the barrel assembly and the frame are in the break-open position.

5. In a break-open firearm having a barrel assembly and a frame hinged to each other, said barrel assembly comprising an elongated barrel and a magazine tube for receiving and storing cartridges, said magazine tube mounted below and parallel to said barrel, means biasing said cartridges rearwardly out of said magazine tube, means on said frame for selectively preventing expulsion of the rearmost cartridge from said magazine tube while the barrel assembly and frame are in the locked, operative position, and shell cut-off latch means mounted on said barrel assembly to prevent the rearmost cartridge from being expelled from the magazine tube when the barrel assembly and frame are pivoted so as to be in the break-open position.

6. In a break-open firearm as recited in claim 5 wherein said shell cut-off latch comprises a U-shaped member having a pair of legs pivoted to said barrel assembly and a connecting rear portion with a cartridge-engaging lip thereon positioned at the rear end of the magazine tube, and means biasing said shell cut-off latch so that said lip normally projects downwardly into the path of the rearmost cartridge in the magazine tube when the barrel assembly and the frame are in the break-open position.

7. In a break-open firearm as recited in claim 6 wherein said cut-off latch has a cam means thereon, an action slide means mounted on said frame, a cam surface on said action slide means which engages the cam means on said cut-off latch when said action slide means is moved to its forward, breech locked position whereupon said cut-off latch is cammed upwardly so that the lip is moved out of cartridge engaging position.

8. In a break-open firearm as recited in claim 7 wherein said cam means on said cut-off latch comprises a finger integrally formed with said cut-off latch, said finger extending upwardly and rearwardly from the rear end of said U-shaped member and having a cam surface thereon which is engaged by the action slide means cam surfaces.

* * * * *